United States Patent [19]

Wright

[11] Patent Number: 4,765,768

[45] Date of Patent: Aug. 23, 1988

[54] RING BINDING MECHANISM

[76] Inventor: John S. Wright, 6115 N. Lake Drive Ct., Milwaukee, Wis. 53217

[21] Appl. No.: 88,725

[22] Filed: Aug. 24, 1987

[51] Int. Cl.[4] ..... B42F 13/20

[52] U.S. Cl. ..... 402/30; 402/29

[58] Field of Search ..... 402/4, 21, 26, 27, 28, 402/29, 30, 45, 60, 66, 80 R, 80 P

[56] References Cited

U.S. PATENT DOCUMENTS

| | | | |
|---|---|---|---|
| 779,879 | 1/1905 | Sheridan et al. | 402/29 |
| 2,068,229 | 1/1937 | Fahrnbühl | 402/29 |
| 3,313,303 | 4/1967 | Beyer | 402/30 X |
| 3,313,304 | 4/1967 | Beyer | 402/30 X |

FOREIGN PATENT DOCUMENTS

| | | | |
|---|---|---|---|
| 212529 | 3/1957 | Australia | 402/29 |

*Primary Examiner*—Paul A. Bell

*Attorney, Agent, or Firm*—Glenn A. Buse'

[57] ABSTRACT

The ring binding mechanism includes one or more partial rings which are slidably mounted in arcuate tracks in a base plate member for rotational movement between a loading position wherein an opening between the ends of the rings is accessible to install or remove sheets of paper or the like and a loaded position wherein the opening is located beneath the surface of the base plate member. The tracks, base plate member and rings include parts which cooperate to releasably lock the rings in the loaded position. In one embodiment, the ring binding mechanism is installed on a one-piece cover including a spine section defined between laterally spaced hinged sections. The spine section is either mounted directly on the base plate member or sandwiched between the base plate member and a back plate member which are secured together with snap-in fingers. The binder can be transported in an unassembled condition and assembled at the point of use by the user.

21 Claims, 3 Drawing Sheets

RING BINDING MECHANISM

BACKGROUND OF THE INVENTION

This invention relates to ring binding mechanisms and, more particularly, to the heavy duty ring binding mechanisms for sheet materials such as paper and the like.

Heavy duty ring binders used for photo albums, parts catalogs, salesmen presentation kits, student notes and classroom materials, office records and the like typically include a plurality of generally O-, U- or D-shaped metal rings for holding apertured sheets of paper or the like. These rings divide in half to open and are opened individually or together to remove, replace or add sheets. With minimum use, the area around the holes of the sheets become torn from the misaligned and jagged ends of these rings. Consequently, for many applications the area of the sheets surrounding the holes must be reinforced.

Conventional heavy duty binders have a number of other shortcomings. Assembly costs represent a large percentage of the total cost of production, up to as much as 50% or more in some cases. Empty binders occupy a substantial amount of unusable space, making it uneconomical to transport them for any distance more than a few hundred miles and requiring unnecessarily large storage spaces for inventories maintained by retailers or companies using a large number of binders. The covers of some binders are colored and/or permanently decorated and usually are discarded when it becomes necessary to change the color or the identification on the cover.

SUMMARY OF THE INVENTION

An object of the invention is to provide an easy-to-assemble binding ring mechanism which can be used by itself or with a cover.

Another object of the invention is to provide a ring binder which can be transported and stored in a "knocked down" or unassembled condition and assembled at the point of use.

A further object of the invention is to provide a ring binding mechanism having a ring construction which minimizes wear and tear to the edges of holes in sheet material.

A still further object of the invention is to provide a ring binder including a cover which is arranged so that identifying material can be conveniently interchanged.

Other objects, aspects and advantages of the invention will become apparent to those skilled in the art upon reviewing the following detailed description, the drawings and the appended claims.

The invention provides a ring binding mechanism including one or more partial rings having ends which are circumferentially spaced to define an opening for placing apertured sheets on the ring(s), a base plate member having a transversely extending internal track for slidably receiving each ring for rotational movement relative to the base plate member about an axis generally parallel to the longitudinal axis thereof, between a loading position wherein the opening is located away from the front side of the base plate member and a loaded position wherein the opening is located beneath the front side of the base plate member, and means for releasably locking each ring in the loaded position. The ring binding mechanism can include latching means for releasably latching the ring(s) in a wide ope loading position for installation or removal of sheets.

In one embodiment, the ring binding mechanism includes a back plate member having a plurality of snap-in fingers which are received in apertures in the base plate member and cooperate therewith to secure the base plate member and the backup member together.

In one embodiment, a cover is mounted on the ring/-base plate member subassembly to form a binder. The cover has a front, a back and a pair of laterally spaced, parallel hinge sections defining a spine section therebetween and the spine section is mounted directly to the backside of the base plate member or, when a back plate member is used, is sandwiched between the back side of the base plate member and the backup member.

The ring binding mechanism or binder can be transported in a "knocked down" or unassembled condition and conveniently assembled at the point of use, thereby reducing the amount of space requried for transportation and storage and eliminating assembly costs.

DESCRIPTION OF THE PREFERRED EMBODIMENT

Figures 1, 2:
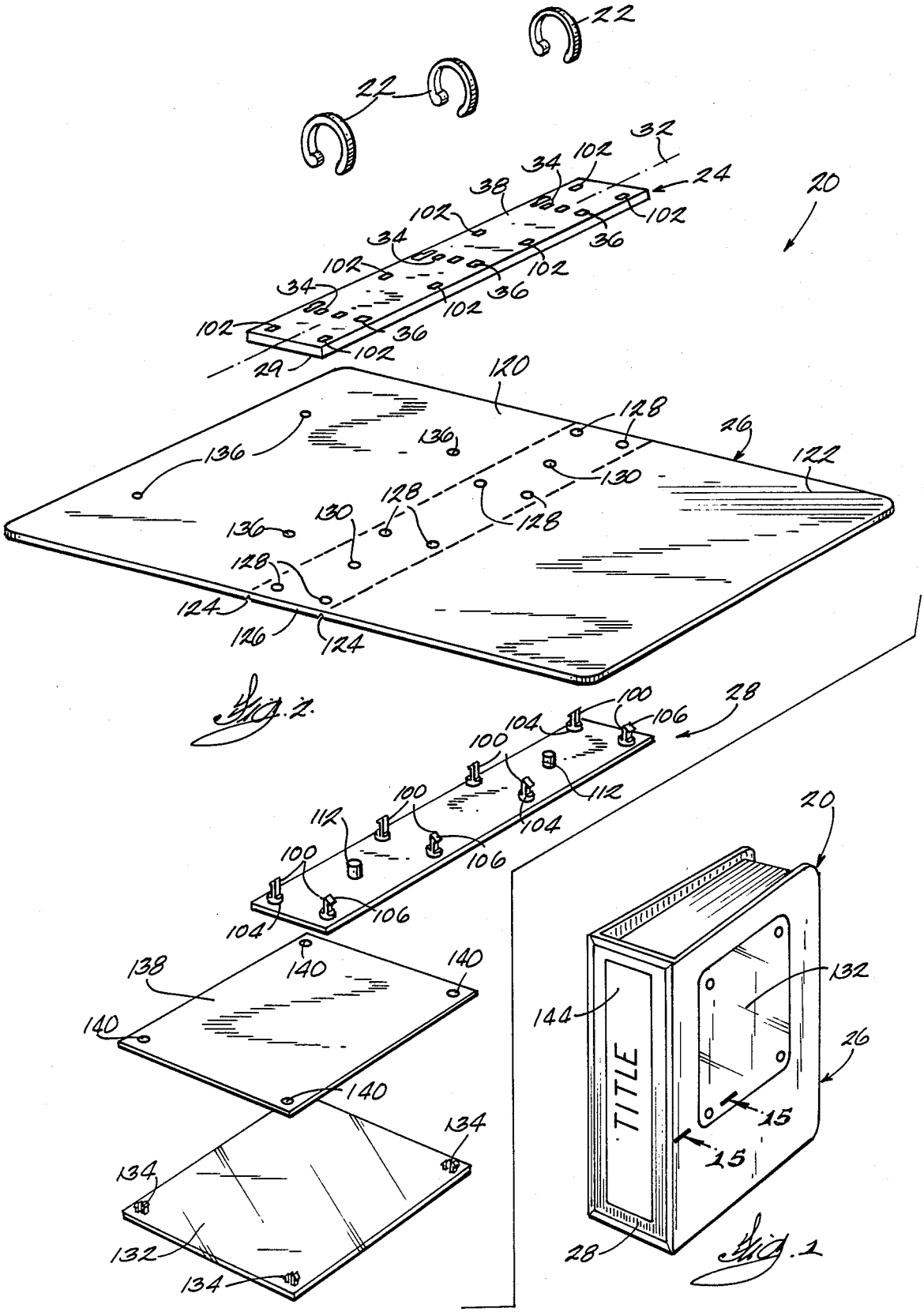
FIG. 1 is a perspective view of a three-ring binder embodying the invention.
FIG. 2 is an exploded, perspective view of the components for the binder illustrated in FIG. 1.

Referring to FIGS. 1 and 2, a binder 20 embodying the invention includes three, generally C-shaped, partial rings 22, a base plate member 24, a cover 26 and a backup member 28 secured to the back side 29 of the base plate member 24.

Figure 4:
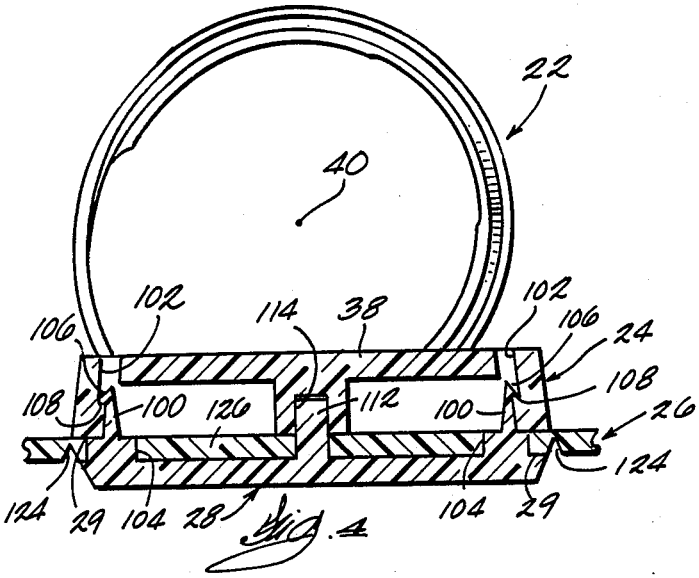
FIG. 4 is an enlarged, sectional view taken generally along line 4—4 in FIG. 3.

The base plate member 24 includes a plurality of internal tracks 30 (one shown in FIG. 4) which extend transversely of the longitudinal axis 32 of the base plate member 24 and have opposite ends 34 and 36 which are open at the front side 38 of the base plate 24 to slidably receive the rings 22. The tracks 30 are arcuate and permit rotational movement of the rings 22 relative to the base plate member 24 (about an axis 40 generally parallel to the longitudinal axis 32) between a loading position illustrated in FIG. 6 and a loaded position illustrated in FIG. 5.

The rings 22 are made from a material which is relatively rigid, but still resilient enough to accommodate the deflection required for locking and unlocking as described below. While the rings can be made from a metal, they preferably are molded from a filled or unfilled, relatively rigid, durable plastic material, particularly a synthetic thermoplastic.

Each ring 22 (FIGS. 4 and 6) includes first and second end portions 42 and 44 which are circumferentially spaced to define an opening 46 therebetween for receiving apertured sheets of paper or the like when the rings 22 are in a loading position. When the rings 22 are rotated to the loaded position, the first end portions 42 are located inside the track 30 and means are provided for releasably locking the rings 22 in the loaded position. As described in more detail below, the second end portions 44 actually are first inserted into the tracks 30 through openings 34 during assembly.

Figure 10:
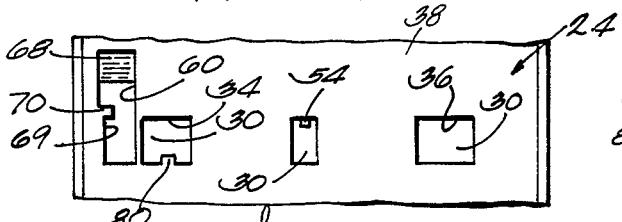
FIG. 10 is an enlarged, fragmentary top plan view of a portion of a base plate member in which a ring is installed.

In the specific construction illustrated, the ring locking means includes one side 50 of each ring 22 having a circumferentially-extending groove 52 (FIG. 8) which receives a projection or stop 54 in the track 30 (FIG. 10). The groove 52 includes an end wall (not shown) which is engaged by the stop 54 to limit further rotation of the ring 22, in the counterclockwise direction as viewed in FIG. 5, when the first end portion 42 is in the loaded position. The second end portion 44 of the ring 22, includes a necked-down or reduced section 56 and a terminal bulb-like section 58.

Figure 12:
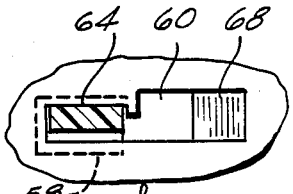
FIG. 12 is a partial sectional view taken generally along line 12—12 in FIG. 11 and rotated 90°.

The base plate member 24 includes a longitudinally extending locking recess 60 spaced outwardly from and aligned with each track 30 for lockingly receiving the second end portion 44. The locking recess 60 has an enlarged lower portion 62 (FIG. 6) for receiving the bulb-like portion 58 on the ring 22, a slightly narrowed, longitudinally extending upper portion 64 for receiving the reduced section 56 and a bottom surface 66 along which the bulb-like section 58 rides as the second end portion 44 of the ring 22 is moved into a locked position. Extending longitudinally from the locking recess 60 is an upwardly inclined ramp 68 (FIGS. 10 and 12) which facilitates removal of the second end portion 44 from the locking recess 60.

Figure 11:
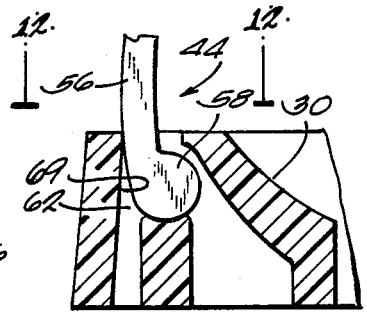
FIG. 11 is an enlarged, fragmentary and sectional view showing a ring in a locked position
Figure 5:
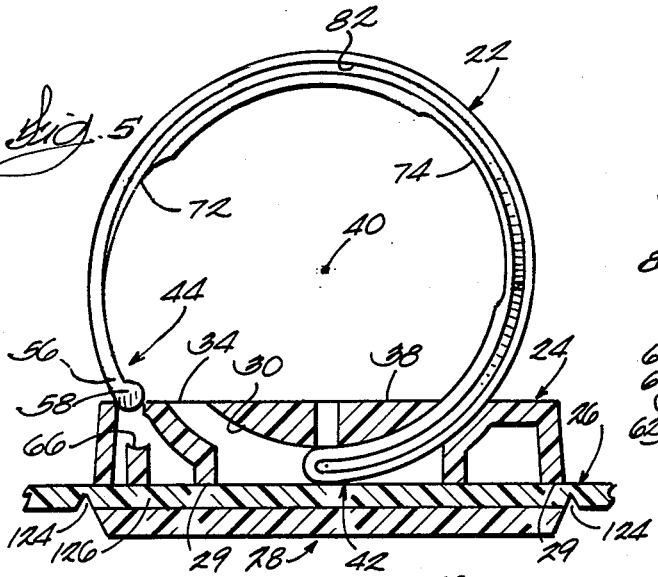
FIG. 5 is an enlarged, sectional view taken generally along line 5—5 in FIG. 3.

To lock a ring 22 in the loaded position, it is first rotated to the loaded position illustrated in FIG. 5. The bulb-like section 58 is pushed down into the lower portion 62 of a locking recess 60 and then moved in a locking direction (downwardly as viewed in FIG. 10) to the locked position illustrated in FIG. 11. When in the locked position, the bulb-like section 58 engages the narrow or upper portion 64 of the locking recess 60 to prevent movement of the ring 22 toward the loading position (in a counterclockwise direction as viewed in FIG. 4). The resilient characteristic of the ring material biases the second end portion 44 outwardly against an inner wall 69 of the lower portion 62 of the locking recess 60.

An inwardly extending projection 70 engages an edge of the reduced section 56 and acts as a stop when longitudinal movement of the second end portion 44 of the ring 22 toward an unlocked position is attempted without first deflecting the second end portion 44 inwardly. When the second end portion 44 is deflected inwardly (to the right as viewed in FIG. 11), the reduced portion 54 can be moved in an unlocking direction through the opening between the inner edge of the projection 70 and the outer side of the recess 60 and thereafter is guided out of the locking recess 60 by the ramp 68. The ring 22 can then be rotated in a clockwise direction to the loading position. Such an arrangement minimizes accidental unlocking of the rings.

Reduced areas 72 and 74 in the inner periphery of the ring 22 facilitates the slight bending required to lock and unlock the second end portion 44 into and from the locking recess 60.

Figure 6:
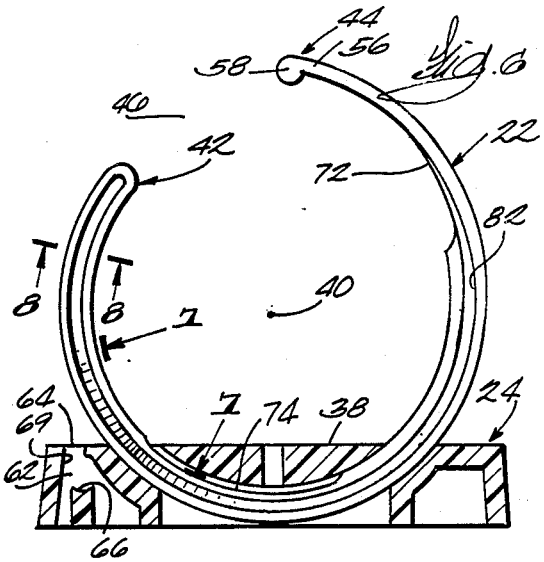
FIG. 6 is a view similar to FIG. 5 showing a ring in the wide open loading position and with the cover and back plate member removed.

Means preferably are provided for releasably latching the ring 22 on a wide open position illustrated in FIG. 6 wherein the opening 46 is generally inverted from its location when in the loaded position. Such latching means is arranged to align the ends of the rings 22 and prevent them from moving from the loading position when sheets are being installed onto or removed from the rings.

Figure 7:
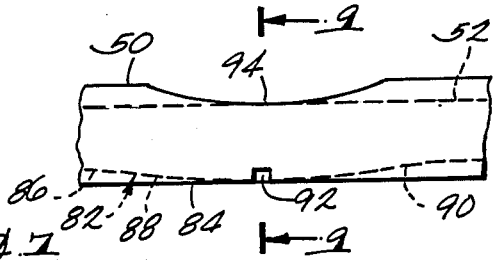
FIG. 7 is an enlarged, sectional view taken generally along line 7-7 in FIG. 6 and rotated 90°.
Figure 9:
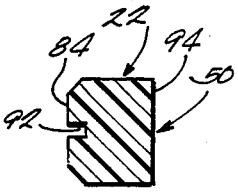
FIG. 9 is an enlarged, sectional view taken generally along line 9—9 in FIG. 7.

In the specific construction illustrated, the latching means includes a detent projection 80 (FIG. 10) in the track 30 near the opening 34 and a circumferentially-extending groove 82 in the side 84 of the ring opposite to the groove 52. A portion of the bottom wall 86 of the groove 52 (FIG. 7) is inclined outwardly to form ramps 88 and 90 which converge toward a detent recess 92. The detent recess 92 releasably receives the detent projection 80 when the ring 22 is at a location corresponding to the wide open position. A portion of the side 82 of the ring 22 opposite the detent recess 92 (FIGS. 7 and 9) has a relief area or recess 94 which permits the ring 22 to be deflected in a direction away from the detent projection 80.

As the ring 22 is rotated in a clockwise direction as viewed in FIG. 6 toward the wide open position, the detent projection 80 rides against the bottom wall 86 of the groove 82. When the detent projection 80 engages the ramp 90, it causes the ring 22 to be cammed in a direction away from the projection 80 until the detent recess 92 reaches the detent projection 80, at which time the detent projection 80 snaps into the detent recess 92 and cooperates therewith to releasably hold the ring 22 in the wide open oposition. When the ring 22 is in the wide open position, the opening 46 preferably is somewhat off center with the bulb-like section 58 at about 12 o'clock. This permits more sheets to be loaded onto one side of the ring 22.

The ring 22 can be released by deflecting the first end portion 42 in the direction away from the detent projection 80 to disengage the detent recess 92 from the detent projection 80. The ring 22 can then be rotated in a counterclockwise direction as viewed in FIG. 6 and locked in the loaded position as described above.

Figure 8:
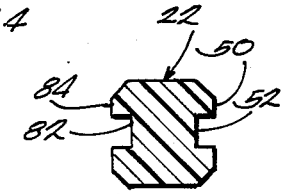
FIG. 8 is an enlarged, sectional view taken generally along line 8—8 in FIG. 6.

The rings 22 and the tracks 30 have a complementary cross-sectional configuration which prevents rotation of the rings 22 relative to the base plate member 24 about an axis transverse to the longtidunal axis 32 of the base plate member 24. In the specific construction illustrated, the rings 22 and the tracks 30 have a plurality of complementary flat surfaces (FIG. 8). The rings 22 preferably have chambered corners as illustrated to facilitate installation and removal of sheets.

The back plate member 28 (FIGS. 2 and 4) is secured to the back side 29 of the base plate member 24 by a plurality of snap-in fingers 100 which fit into apertures 102 in the base plate member 24. Each finger 100 has a cylindrical base 104, a cam surface 106 and a lip 108 which rests on a ledge inside an aperture 102 in the base plate member 24. The back plate member 28 also includes a plurality of longitudinally spaced pins 112 which fit into bosses 114 on the underside of base plate member 24. The pins 112 serve to index the fingers 100 with the apertures 102 during assembly of the base plate member 24 and the back plate member 28 and also prevent relative lateral and longitudinal movement of the base plate member 24 and the back plate member 28 after assembly.

As the base plate member 24 and the back plate member 28 are moved toward each other during assembly, the cam surfaces 106 on the fingers 100 ride against an inner wall 116 of the base plate member 24 and the fingers 100 are deflected inwardly until the lips 108 reach the ledges, at which time the fingers 100 snap back toward their original position and the lips 108 engage the ledges to hold the base plate member 24 and the back plate member 28 together.

The base plate member 24 and the back plate member 28 preferably are molded from a relatively rigid, synthetic thermoplastic material.

The rings 22, base plate member 24 and back plate member 28 can be used as a binder assembly when a cover is not needed. In the embodiment illustrated in FIGS. 1 and 2, the binder 20 includes a one-piece cover 26 having a front 120, a back 122 and a pair of laterally-spaced "living" hinge sections 124 in the form of V-shaped grooves defining a spine section 126 therebetween. The spine section 126 includes a plurality of apertures 128 and 130 for respectively receiving the finger bases 104 and the pins 112 on the backup member 28. The spine section 126 (FIG. 4) is fitted over the finger bases and the pins and becomes clamped or sandwiched between the back side 29 of the base plate member 24 and the back plate member 28 when these two parts are secured together during assembly.

Figure 15:
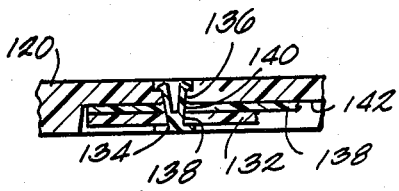
FIG. 15 is an enlarged, sectional view taken generally along line 15—15 in FIG. 1.

The cover 26 preferably is designed so that the decorative and/or printed material on the cover front 120 can be changed when it is desired to use the binder for a different purpose or store different records. Provided for this purpose (FIGS. 1, 2 and 15) is a transparent panel 132 which is secured to the cover front 120, preferably removably secured by a plurality of snap-in fasteners 134 which are pressed through apertures 136 in the cover front 120. The panel 134 covers a sheet 138 of paper or the like including indicia, such as company name, description of contents, decorative material, etc. The sheet 138 includes apertures 140 for receiving the snap-in fasteners 134 and is sandwiched between the panel 132 and the cover front 120.

The cover front 120 (FIG. 15) preferably includes a recess 142 which receives the sheet 138 and the panel 132 and is deep enough so that the heads of the fasteners 134 do not protrude beyond the surface of the cover front 120 and catch on contiguous binders, books, etc. when the binder is shelved. When it is desired to change indicia, the panel 132 and the sheet 138 are removed from the cover front 120 (after squeezing the inner ends of the fasteners 134), the sheet 138 replaced and the panel and new sheet mounted back on the cover front 120.

A replaceable strip 144 of pressure sensitive tape or the like including decorative or informational indicia can be mounted on the outer surface of the back plate member 28 as shown in FIG. 1. The strip 144 can be replaced when the binder is to be used for different purpose or to store different records.

While the cover 26 can be made from a wide variety of materials including cardboard, paperboard, etc., by itself or covered with cloth, vinyl, etc., it preferably is made from a synthetic thermoplastic material. Such materials are tough, are commercially available in a wide range of colors, can be provided with a variety of different finishes, e.g., smooth, leather grain finish, etc,, and, by using a heated die, round corners, all the apertures and hinge sections can be formed with a single die cut, thereby reducing fabrication costs.

While the illustrated embodiment includes three rings, as few as one ring and up to four or more can be used. As mentioned above, the binder can be used without a cover. For instance, after records cease to be current, they can be transferred from a binder including a cover to one including only one or more rings and a base plate member, with or without a back plate member, for permanent storage. This partial assembly can be placed in a thin, inexpensive box-like cover to store the records on shelves.

Figure 16:
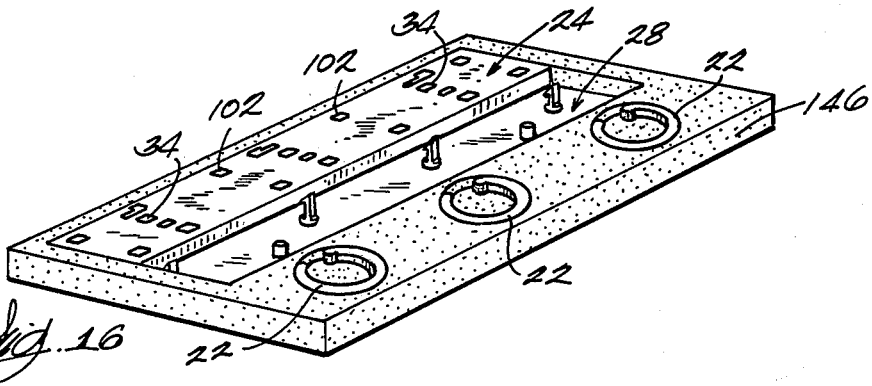
FIG. 16 is a perspective view of a shipping package for the rings, base plate member and backup member.

One particularly advantageous feature of the ring binding mechanism of the invention is that it can be transported and even retailed in a "knocked down" or unassembled condition and assembled at the point of use. For example, the rings 22, the base plate member 24 and the back plate member 28 can be packaged in a styrofoam packet 146 like that illustrated in FIG. 16. Several of these packets and a corresponding number of covers can be stacked into one carton for shipment. The binders can be stored in this unassembled condition and assembled as needed for use. If desired, all the components for a binder can be packaged as a unit and sold to end users who do the assemblying. In either case, the unassembled binders occupy at least 40% less space than many conventional binders of the same size. Assembly costs, a major part of the overall cost of conventional binders, are eliminated because the customer, retailer or someone else in the distribution chain does the actual assembly.

Because the ring binding mechanism can be transported in the unassembled condition and assembled at the point of use, it is possible to market and manufacture on an international level. Individual components can be manufactured in different countries and shipped to world-wide distribution centers. By importing components, rather than finished goods, tariffs can be reduced to a minimum.

The binder can be conveniently assembled as follows: The rings 22 are first installed on the base plate member 24. The second end 44 of a ring 22 is inserted into a track 30 through an opening 34, rotated counterclockwise as viewed in FIGS. 5 and 6 to the loaded position and then locked as described above. The spine section 126 of a cover 26 is fitted onto the back plate member 28 with the fingers 100 and the pins 112 extending through respective apertures 128 and 130. The rings/base plate member subassembly is pressed down over the fingers 100 and the pins 112 and snapped into place.

Figure 3:
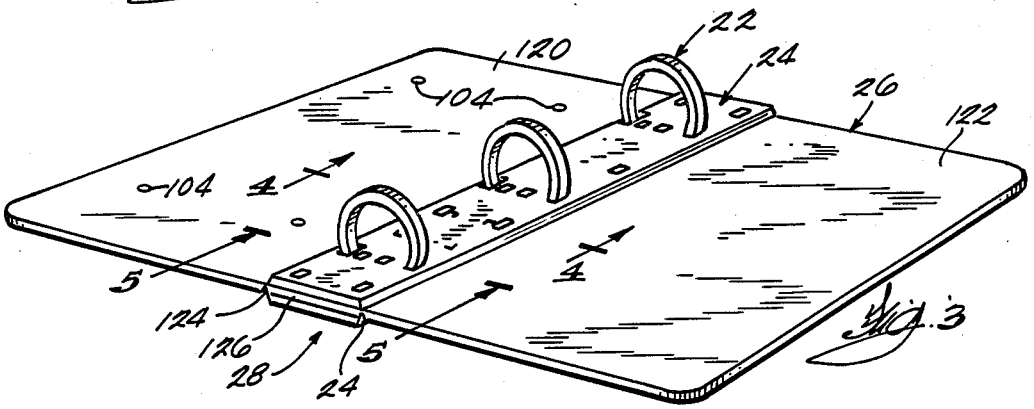
FIG. 3 is a perspective view of an assembled binder with the cover open and the rings in the loaded position.

To use the binder, the cover 26 is opened as illustrated in FIG. 3, the rings 22 are unlocked by removing the second ends 44 from the locking recesses 60, the rings 22 are rotated clockwise as viewed in FIGS. 5 and 6 to a loading position, apertured sheets are installed on the rings 22 and the rings 22 are rotated counterclockwise to a locked, loaded position. During use, the unique ring configuration minimizes wear and tear on the sheets stored in the binder. The need for hole reinforcement is minimized and even eliminated for some applications.

Figure 13:
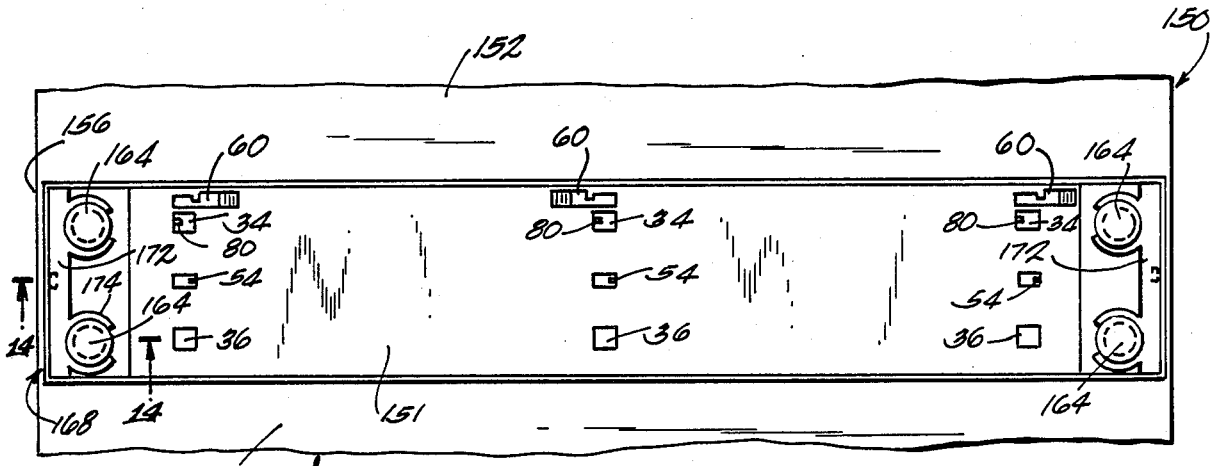
FIG. 13 is a fragmentary, top plan view of an alternate embodiment in which the binder mechanism includes a base plate member which can be mounted directly on a cover, shown without the rings installed.
Figure 14:
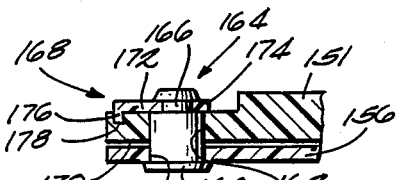
FIG. 14 is an enlarged, sectional view taken generally along line 14—14 in FIG. 13.

In the embodiment illustrated in FIGS. 13 and 14, a cover 150 similar to the cover described above is mounted directly on the base plate member 151. The cover 150 includes a front 152, a back 154 and a pair of laterally-spaced hinge sections (not shown) defining a spine section 156 therebetween. Each end of the spine section 156 includes a pair of apertures 158 (one shown in FIG. 14) for receiving pins 160 which extend through apertures 162 (one shown in FIG. 14) in the base plate member 151.

The inner end 164 of each pin 160 has an undercut portion 166 into which a generally C-shaped clip on a fastener 168 is snugly snapped to secure the cover spine section 156 against the back side 170 of the base plate member 151. Each fastener 168 has an elongated part 172 which carries a pair of clips 174 and includes a depending tongue 176 which fits snugly into a slot 178 in the base plate member 151 to restrain relative longitudinal movement of fastener 168 after assembly. The opposite ends of the base plate member 151 preferably are recessed in the area where the fasteners 168 are mounted so that the inner ends 164 of the pins 160 do not protrude above the front side of the base plate member 151.

When a binder holding sheets is stood on end or accidently dropped on the upper or lower edge, there is a possibility that the force imposed on the rings 22 could cause the second end portion 44 of the rings to unlock. If all the rings 22 become unlocked, some or all of the sheets could fall off the rings 22 and be scattered about. This potential problem can be minimized by arranging the locking recesses 60 so that at least one extends in an longitudinal direction opposite to that of others. For example, referring to FIG. 13, the locking recess 60 for the center ring extends to the left and the locking recesses 60 for the two end rings extend to the right. If the binder is stood or dropped on the right end, there is a possibility that both the end rings could be unlocked by the downward force imposed on them. However, such a downward force would not unlock the center ring and the sheets would be retained in place.

From the foregoing description, one skilled in the art can easily ascertain the essential characteristics of the invention and, without departing from the spirit and scope thereof, make various changes and modifications to adapt it to various usages.

I claim:

1. A ring binding mechanism including a partial ring having a body including first and second ends which are circumferentially spaced to define an opening for placing apertured sheets on said ring;

a base plate member having a front side, a back side, a longitudinal axis and an internal track which is an integral part of said base plate member and extends transversely of said longitudinal axis for slidably receiving said ring body from said front side for rotational movement of said ring relative to said base plate member in opposite directions about an axis generally parallel to said longitudinal axis between a loading position wherein said opening is located away from said front side of said base plate member and a loaded position wherein said opening is located beneath said front side of said base plate member;

motion limit means on said base plate member and on said ring which cooperpate to prevent further rotation of said ring in the direction toward loaded position after said first end of said ring reaches the loaded position; and locking means on said second end of said ring and on said base plate member which cooperate to releasably lock said second end of said ring in the loaded position.

2. A ring binding mechanism according to claim 1 wherein said ring in cross-section includes at least one flat surface; and said track includes a complementary surface for cooperating with said ring surface to prevent rotational movment of said ring relative to said base plate member about an axis transverse to said longitudinal axis.

3. A ring binding mechanism according to claim 1 including latching means on said base plate member and on said ring which cooperate to releasably latch said ring in a wide open loading position wherein said opening is generally inverted from its location when said ring is in the loaded position.

4. A ring binding mechanism according to claim 3 wherein said latching means includes a detent projection in said track; and a detent recess in said ring at a location corresponding to the wide open position for releasably receiving said detent projection.

5. A ring binding mechanism according to claim 1 wherein said motion limit means comprises one side of said ring including a circumferentially extend groove having an end wall;

a projection in said track which rides in said groove during rotational movement of said ring between the loaded and loading positions and which engages said end wall during rotational movement of said ring toward the loaded position to prevent further rotational movement in that direction after said first end of said ring reaches the loaded position; and wherein said locking means comprises said second end of said ring having a reduced section and a terminal bulb-like section; and a locking recess in said base plate member spaced outwardly from and aligned with said track, said locking recess having an enlarged lower portion for receiving said bulb-like section when said ring is in the loaded position and a narrower upper portion for receiving said reduced section during movement of said second end portion of said ring in a locking direction toward a locked position and for engaging said bulb-like section to releasably prevent rotational movement of said ring toward the loading position.

6. A ring binding mechanism according to claim 5 wherein said locking recess further includes retainer means for releasably preventing said second end portion of said ring from being moved in an unlocking direction toward an unlocked position opposite to said locking direction.

7. A ring binding mechanism according to claim 6 wherein said retainer means includes an inwardly extending projection in said locking recess for releasably engaging said reduced section when said second end portion is in the locked position and for permitting said reduced section to be moved toward the unlocked position when said second end portion is deflected in a direction away from said projection.

8. A ring binding mechanism according to claim 6 wherein said base plate member includes at least two of said tracks and rings which are longitudinally spaced, said locking recesses extending longitudinally and being arranged so that the unlocking direction of one of said rings is opposite to the unlocking direction of another of said rings.

9. A ring binding mechanism according to claim 1 including a back plate member having a plurality of snap-in fingers; and said base plate member having a plurality of apertures open at said back side for receiving said snap-in fingers on said backup member and cooperating therewith to secure said base plate member and said backup member together.

10. A ring binding mechanism according to claim 9 wherein said back plate member includes a plurality of longitudinally spaced pins extending toward said base plate member; and said base plate member includes a plurality of longitudinally spaced bosses for receiving said back plate member pins and preventing substantial relative movement of said back plate member and said base plate member after assembly.

11. A ring binding mechanism according to claim 1 including a cover having a front, a back and a pair of laterally spaced, parallel hinge sections defining a spine section therebetween; and means for mounting said spine section on said back side of said base plate member.

12. A ring binding mechanism according to claim 11 wherein said mounting means includes a back plate member having a plurality of snap-in fingers;

said base plate member having a plurality of apertures open at said back side for receiving said snap-in fingers on said back up member and cooperating therewith to secure said base plate member and said back plate member together;

a plurality of apertures in said cover spine section through which said snap-in fingers on said back plate member extends; and said cover spine section being sandwiched between the back side of said base plate member and said back plate member.

13. A ring binding mechanism according to claim 12 wherein said rings, said base plate member said back plate member, and said cover are formed from a synthetic plastic material.

14. A ring binding mechanism according to claim 11 wherein said mounting means includes a plurality of alignable apertures extending through said spine section and said base plate member;

a pin extending through each of said aligned apertures and having an inner end projecting through said base plate member; and fastening means mounted on said pin inner ends to secure said cover and said base plate member together.

15. A ring binding mechanism according to claim 14 wherein said rings, said base plate member and said cover are formed from a synthetic plastic material.

16. A ring binding mechanism according to claim 11 including a panel of transparent material;

a recess in the outer surface of said cover front for receiving said panel and a sheet of material including indicia; and means for removably fastening said panel in said recess with said panel overlaying said sheet.

17. A ring binding mechanism according to claim 16 wherein said panel fastening means comprises a plurality of snap-in fasteners which extend through apertures in said panel and said cover front.

18. A binder including a plurality of partial rings having a body including first and second ends which are circumferentially spaced to define an opening for placing apertured sheets of said rings;

a base plate member having a front side, a back side, a longitudinal axis and internal tracks which are an integral part of said base plate member and extend transversely of said longitudinal axis for slidably receiving each of said rings from said front side for rotational movement of said rings in opposite direction relative to said base plate member about an axis generally parallel to said longitudinal axis between a loading position wherein said opening is located away from said front side of said base plate member and a loaded position wherein said opening is located beneath said front side of said base plate member;

motion limit means on said base plate member and on each said ring which cooperate to prevent further rotation of said ring in the direction toward the loaded position after said first end of said ring reaches the loaded position;

locking means on said second end of each said ring and on said base plate member which cooperate to releasably lock said second end of said ring in the loaded position;

a cover having a front, a back and a pair of laterally spaced, parallel hinge sections defining a spine section therebetween; and means for mounting said spine section on said backside of said base plate member.

19. A binder according to claim 18 wherein said motion limit means comprises one side of said ring including a circumferentially extending groove having an end wall; and a projection in said track which rides in said groove during rotational movement of said ring between the loading and loaded positions and which engages said end wall during rotational movement of said ring toward the loaded position to prevent further rotational movement in that direction after said first end of said ring reaches the loaded position; and wherein said locking means comprises said second end of said ring including a reduced section and a terminal bulb-like section; and a locking recess in said base plate member spaced outwardly from and aligned with said track, said locking recess having an enlarged lower portion for receiving said bulb-like section when said ring is in the loaded section and a narrower upper portion for receiving said reduced section during movement of second end portion in a locking direction toward a locked position and for engaging said bulb-like section and releasably preventing rotational movement of said ring toward the loading position, said locking recess further including retainer means for releasably preventing said second end portion of said ring from being moved in an unlocking direction toward the unlocked position opposite to said locking direction.

20. A binder according to claim 18 including a panel of transparent material;

a recess in the outer surface of said cover front for receiving said panel and a sheet of material including indicia; and means for removably mounting said panel in said recess with said panel overlaying said sheet.

21. A binder according to claim 20 including latching means on said base plate member and on said ring which cooperate to releasably lock said ring in a wide open position wherein said opening is generally inverted from its position when said ring is in the loaded position, said latching means including a detent projection in said track and a detent recess in said ring at a location corresponding to the wide open position for releasably receiving said detent projection.

* * * * *